United States Patent [19]

Theurer

[11] 4,240,352

[45] Dec. 23, 1980

[54] MOBILE TRACK TAMPER

[75] Inventor: Josef Theurer, Vienna, Austria

[73] Assignee: Franz Plasser Bahnbaumaschinen-Industriegesellschaft m.b.H., Vienna, Austria

[21] Appl. No.: 54,131

[22] Filed: Jul. 2, 1979

Related U.S. Application Data

[63] Continuation-in-part of Ser. No. 834,402, Sep. 19, 1977, abandoned, which is a continuation-in-part of Ser. No. 695,733, Jun. 14, 1976, Pat. No. 4,069,763.

[30] Foreign Application Priority Data

Feb. 4, 1977 [AT] Austria ..... 750/77

[51] Int. Cl.[3] ..... E01B 27/16

[52] U.S. Cl. ..... 104/12

[58] Field of Search ..... 104/12, 7 R, 7 B; 184/24; 74/18.2

[56] References Cited

U.S. PATENT DOCUMENTS

| | | | |
|---|---|---|---|
| 4,069,763 | 1/1978 | Theurer | 104/12 |
| 4,074,631 | 2/1978 | Theurer | 104/12 |

*Primary Examiner*—Richard A. Bertsch

*Attorney, Agent, or Firm*—Kurt Kelman

[57] ABSTRACT

The tamping head on a mobile track tamper includes a pair of rigid tamping tool units each consisting of a T-shaped holder whose vertical arm is mounted on a vertically movable carrier and whose transverse arms each have a tamping tool mounted therein. The tamping tool units are vibrated by an eccentric shaft and reciprocated by hydraulic drives linked to the eccentric shaft and to the vertical arms of the holders, respectively. A housing defining an oil sump in the lower portion thereof is mounted on the carrier and holds the eccentric shaft, and bearings which rotatably mount the eccentric shaft in the housing and link the hydraulic drives to the eccentric shaft being lubricated by the oil from the sump.

8 Claims, 5 Drawing Figures

MOBILE TRACK TAMPER

This is a continuation-in-part of my U.S. patent application Ser. No. 834,402, filed Sept. 19, 1977 now abandoned, which is a continuation-in-part of Ser. No. 695,735, now U.S. Pat. No. 4,069,763, filed June 14, 1976 and granted Jan. 24, 1978.

My copending patent describes and claims a mobile track tamper comprising a frame arranged for mobility on a track consisting of a multiplicity of ties and two rails fastened to the ties. A tamping head is vertically movably mounted on the frame in vertical alignment with a respective one of the rails, and a power drive moves the tamping head vertically. The tamping head includes a pair of rigid ballast tamping tool implement units arranged for reciprocation in the direction of track elongation towards and away from each other and capable of tamping ballast under respective ones of the ties upon vertical downward movement of the tamping head and immersion of the tamping tools in the ballast adjacent the respective ties. The tamping tool implement units are mounted on a carrier and drive means are mounted on the carrier and connected to the units for vibrating and reciprocating the tamping tool implement units. Each unit consists essentially of a tamping tool holder having an arm having a longitudinal plane of symmetry and mounted on the carrier for pivoting in a plane vertical to the track and passing through the rail, the longitudinal plane of symmetry of the tamping tool holder arm extending in the vertical plane and the holder arm being connected to the drive means, and two arms extending transversely of the track and rigidily connected to the vertically extending arm to the left and to the right of the vertical plane, and at least one stationary tamping tool mounted on each of the transversely extending holder arms and extending vertically downwardly from the holder arms for immersion in the ballast to the left and to the right of the rail.

The rigid tamping tool implement units of U.S. Pat. No. 4,069,763 provide strong and robust tamping tools providing a longer operating life than tamping tools heretofore available and also increasing the tamping effectiveness. This type of construction has the particular advantage of providing a greatly simplified tamping tool structure with a common vibrating and a common reciprocating drive for the tools immersed in the ballast right and left of the rail, the force of the drives being transmitted to the tamping tools immersed in the ballast during tamping almost without play.

U.S. Pat. No. 3,589,297, dated June 29, 1971, discloses a mobile track tamper with reciprocating vibratory tamping tools of a generally conventional type and providing an improved lubricating system for the extensive lubrication of the tamping tool bearings. In this system, the pivoting bearings of the tamping tools and the reciprocating drives therefor are housed, at each side of the rail, in respective housings defining oil sumps in the lower portions thereof. The tamping tool holders extend from the housing and gaskets seal off the passages in the housing through which the holders extending to prevent oil leakage. All lubricating points outside the housing are lubricated by a central lubricating system.

It is the primary object of this invention to provide a simple and dependable lubrication for rigid tamping tool implement units of the type hereinabove described and simultaneously to reduce the operating noise of such tamping units, thus further enhancing the capacity and the operating life of the units.

The above and other objects are accomplished in accordance with the invention with a drive means comprising an eccentric shaft and reciprocating elements connected respectively to the eccentric shaft and to the tamping tool implements, a housing on the carrier through which the eccentric shaft extends and defining an oil sump in the lower portion thereof, bearings rotatably mounting the eccentric shaft in the housing, the bearings being lubricated by the oil from the sump, and the outer ends of the reciprocating elements being connected to the vertical arms of the holders, extending from the housing and being guided therein in a manner substantially preventing oil leaking from the housing.

Since the rigid tamping tool implement unit requires only a single vibrating drive and the reciprocating drives for the tamping tools immersed in the ballast to the left and to the right of the rail are mounted on the vibrating drive, the housing holding the eccentric shaft drive can be readily constructed as a sealed oil container. Furthermore, since only two reciprocating drives are required, they may be journaled to the eccentric shaft betwen the two bearings mounting the shaft for rotation in the housing in close spatial relationship, thus making for a very compact structure. This makes the lubrication of all bearings by the oil from the sump very simple, these bearings being subject to considerable loads during the vibratory and reciprocatory movements of the tamping tools while immersed in the ballast.

The lubrication of all lubricating points of the rigid tamping tool implement units outside the housing may be effected in a known manner from a central lubricating system. The mounting of the moving parts of the drive means in the oil-containing housing damps the operating noise.

The above and other objects, advantages and features of the present invention will become more apparent from the following detailed description of a now preferred embodiment thereof, taken in conjunction with the accompanying drawing wherein FIG. 1 is a side elevational view of a tamping head vertically movably mounted on the frame of a mobile track tamper;

Figure 2:
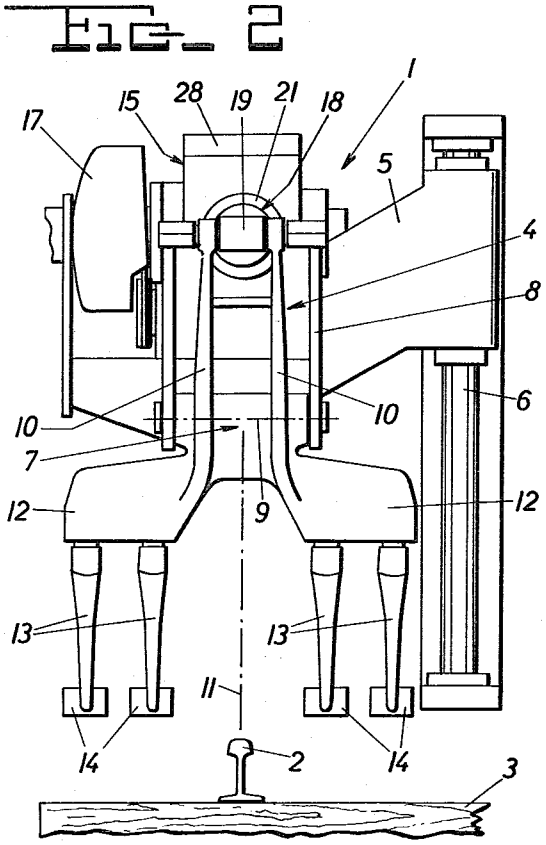
FIG. 2 is a front elevational view of the tamping head.

Referring now to the drawing, tamping head 1 is shown mounted on frame 44 of mobile track tamper 42 arranged for mobility on a track consisting of a multiplicity of ties 3 and two rails 2 fastened to the ties. The tamping head comprises carrier 4 whereon the tamping tool implements are mounted and the carrier has mounting bracket 5 vertically slidable along two vertical guide columns 6 of machine frame 44 so that the tamping head is vertically movably mounted on the frame in vertical alignment with a respective one of rails 2. A power drive constituted by hydraulic motor 45 connects the carrier to the frame for vertically moving the tamping head along the vertical guide columns. This arrangement is generally similar to that of the above-mentioned copending patent, as are the tamping tool implements arranged on each tamping head, a respective tamping head being mounted on the machine frame over each rail although only a single one is shown in the drawing.

As has been described in the patent each tamping head includes a pair of tamping tool implements arranged for reciprocation in the direction of track elongation towards and away from each other and capable of tamping ballast under respective ones of ties 3 upon vertical downward movement of the tamping head and immersion of the tamping tool implements in the ballast adjacent the respective ties. Drive means comprising eccentric shaft 16 for vibrating the tamping tool implements and hydraulic motors 18 for reciprocating the same are mounted on carrier 4, the motors having outer ends 19 linked to the tamping tool implements and inner ends 20 linked to the eccentric shaft. Each tamping tool implement is constituted by a rigid unit consisting essentially of tamping tool holder 7 having arm 10 having longitudinal plane of symmetry 11 and mounted on carrier 4 on pivot axis 9 for pivoting in a plane vertical to the track and passing through the rail, the longitudinal plane of symmetry of the tamping tool holder arm extending in the vertical plane and the holder arm being connected to outer end 19 of a respective one of the piston rods of hydraulic reciprocating motors 18, two arms 12 extending transversely of the track and rigidly connected to vertically extending arm 10 to the left and right of vertical plane 11, and two stationary tamping tools 13 mounted on each transversely extending holder arm 12. The tamping tools extend vertically downwardly from the holder arms for immersion of their tamping jaws 14 in the ballast to the left and to the right of rail 2.

Figure 1:
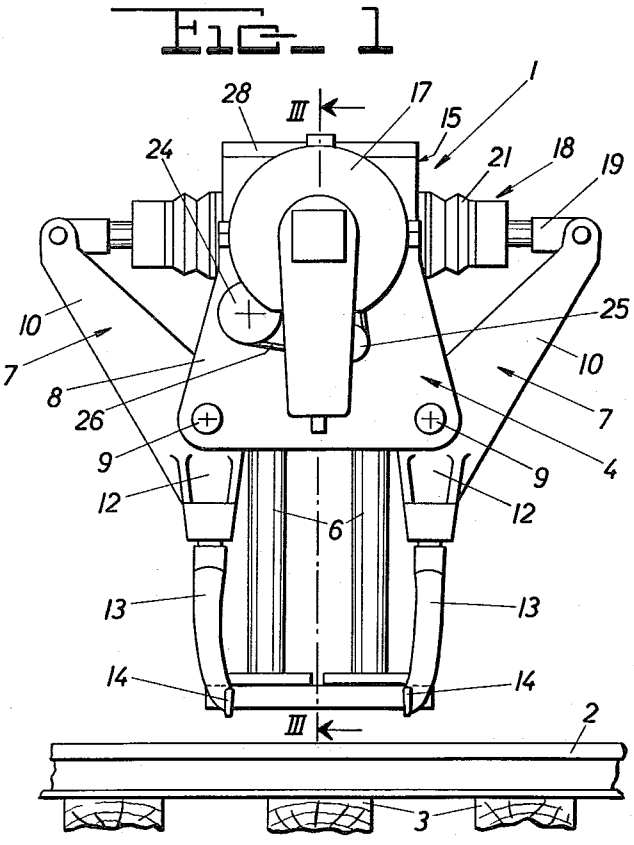
Figure 5:
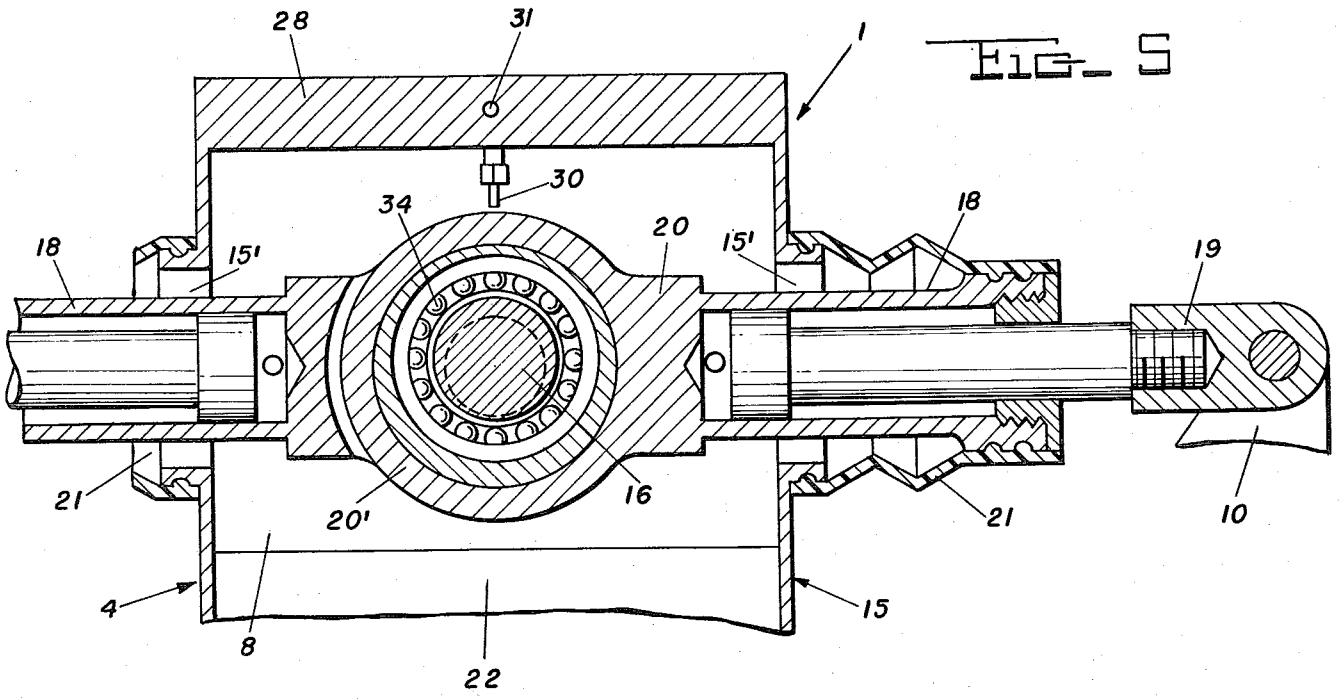
FIG. 5 is a section along line V—V of FIG. 3.

In accordance with the invention, sealed housing 15 is mounted on carrier 4 between support webs 8 thereof and eccentric shaft 16 extends therethrough, the eccentric shaft being driven by hydraulic motor 17 for vibrating the tamping tool implements. As best shown in FIG. 1, each rigid tamping tool implement unit is reciprocated by a single hydraulic motor 18 having a reciprocating piston rod whose outer end 19 is linked to holder arm 10 while the inner end 20 of its cylinder is linked to the eccenter shaft (see FIGS. 3 and 5). Bearings 36, 37 and 38 rotatably mount eccentric shaft 16 in housing 15 while bearings 34 mount the hydraulic reciprocating motors on the eccentric shaft. Elastic, substantially bellows-shaped sealing sleeves 21 have respective ends affixed to housing 15 and the outer ends of the cylinders of hydraulic motors 18, which cylinders extend through bores 15' in the housing. The cylinders guide the reciprocating piston rods out of housing 15 and the sealing sleeves prevent oil from leaking from the housing which defines oil sump 22 in the lower portion thereof. The bearings are lubricated by the oil from the sump.

The sealing sleeves illustrated herein for preventing any substantial leakage of oil from the housing are commercially available sealing devices which are relatively inexpensive and have a long operating life under repeated expansion and retraction by the constantly reciprocating movements of the piston rods. Such sealing sleeves can be readily replaced when worn out.

Figure 3:
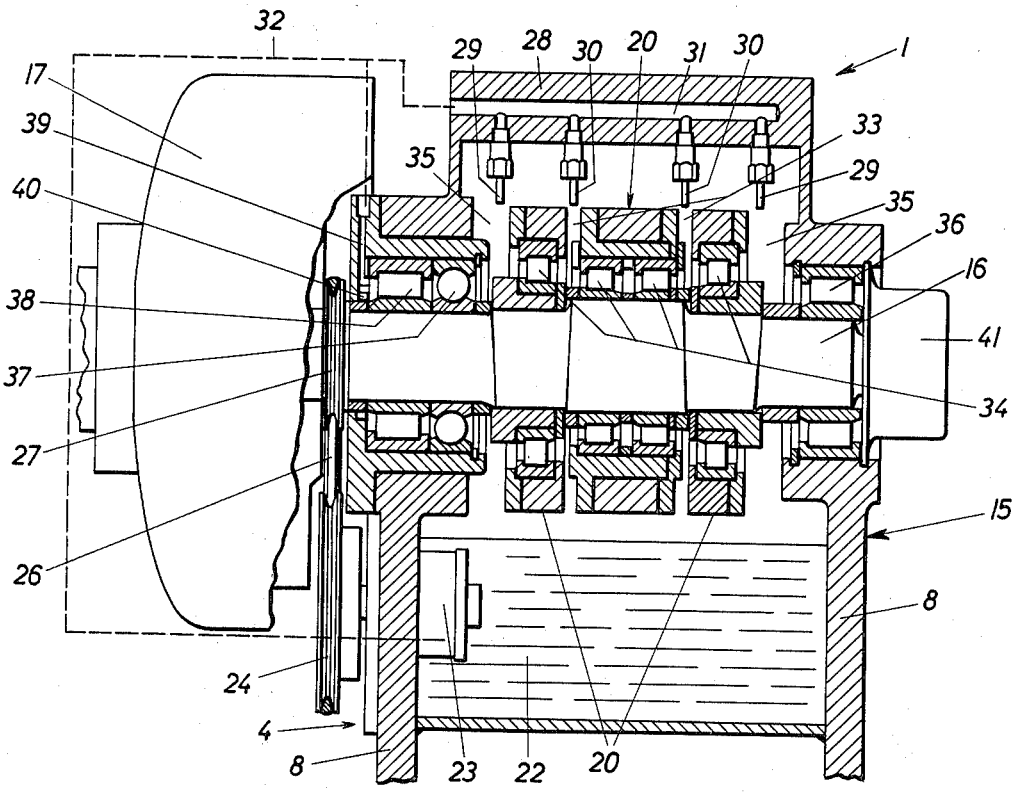
FIG. 3 is a section along line III—III of FIG. 1, on an enlarged scale.
Figure 4:
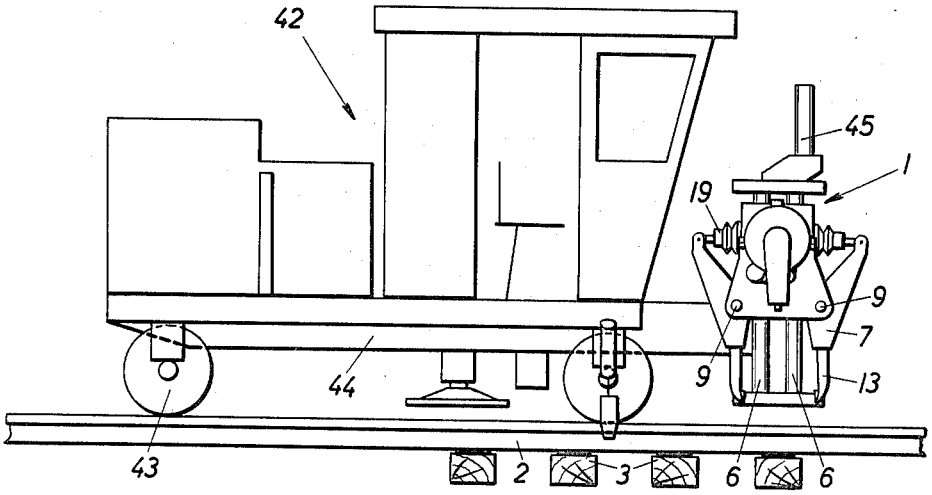
FIG. 4 is a side elevational view showing a mobile track tamper incorporating the tamping head of this invention.

A particularly useful system for lubricating the bearings of the drive means constituted by the hydraulic vibrating and reciprocating motors by the oil from sump 22 has been illustrated in FIG. 3. This system comprises pump 23 which has an input in communication with the oil sump and an output in communication with the bearings for pumping oil from the sump to the bearings. In the illustrated embodiment, lubricating oil is delivered by pump 23 to all the bearings and lubricating points within housing 15. For this purpose, cover 28 of housing 15 carries a bank of downwardly oriented spray nozzles 29 and 30 which are in communication with oil main 31 passing through the cover and receiving oil from the output of pump 23 through connecting conduit 32 (shown in broken line). As will be seen in FIGS. 3 and 5, inner ends 20 of the hydraulic motors 18 have a split sleeve mounted on bearings 34 and defining spaces 33, the split sleeves having radially projecting and axially spaced rings 20' which interdigitate. Spray nozzles 30 are so oriented as to spray oil into spaces 33. In this manner, roller bearings 34, which mount the inner ends of the hydraulic reciprocating motors on the eccentric shaft and which require a great amount of lubrication, receive a constant supply of lubricating oil and are cooled thereby. Outer spray nozzles 29 are so oriented as to spray oil into spaces 35 located between roller bearings 34 and neighboring 36 and 37 of the eccentric shaft in housing 15, thus constantly lubricating these bearings.

The use of an oil delivery pump for lubricating the bearings is more advantageous than submerging the bearings in the oil sump because it enables each bearing to be lubricated by a required amount of oil, and in addition, no loss of power is encountered by mounting rotating parts in the oil bath. The provision of spray nozzles has the particular advantage of forming a continuous lubricating film on the bearings and, furthermore, the oil sprays will provide a cooling effect which increases the operating life of the bearings by the avoidance of overheating.

In the illustrated embodiment and preferably, pump 23 is driven by eccentric shaft 16. For this purpose, a transmission connects the eccentric shaft to the pump shaft for driving the pump, the illustrated transmission being a V-belt drive arranged outside housing 15. This drive comprises pulley 24 mounted at an end of the pump shaft outside housing 15, pulley 27 keyed to the eccentric shaft outside the housing, the V-belt 26 trained over the pulleys, tension roller 25 holding the belt under the required tension. Such a transmission is very advantageous since the driving power of the pump is quite small in comparison to the required power of the eccenter shaft. Therefore, there is no need to increase the power of hydraulic vibrating motor 17 and the pump can be driven without an additional power source.

The third bearing 38 of the eccentric shaft outside housing 15, between bearing 34 and motor 17 is lubricated by the oil from sump 22 through branch conduit 39 leading from conduit 32 to bearing 38.

Gasket 40 seals the bore in housing 15 through which eccentric shaft 16 extends and the opposite bore in the housing is sealed by cap 41 so that substantially no oil can leak from the housing at the points where the eccenter shaft passes out of the housing. Spray nozzles 29 and 30 lubricate all points of hydraulic reciprocating drives 18 within the housing which require lubrication.

Housing 15 is easily made substantially leak-proof since seals are required only at the two points where the eccentric shaft passes through the housing wall and the two points where the hydraulic reciprocating motors pass therethrough. The oil in the housing and the location of the eccentric shaft therein, as well as of the bearings of the hydraulic reciprocating motors thereon, damps the otherwise considerable noise of the tamping tool implements during operation.

What is claimed is:

1. A mobile track tamper comprising a frame arranged for mobility on a track consisting of a multiplicity of ties and two rails fastened to the ties, a tamping head vertically movably mounted on the frame in vertical alignment with a respective one of the rails, and a power drive for vertically moving the tamping head, the tamping head including a pair of tamping tool implements arranged for reciprocation in the direction of track elongation towards and away from each other and capable of tamping ballast under respective ones of the ties upon vertical downward movement of the tamping head and immersion of the tamping tool implements in the ballast adjacent the respective ties, a carrier whereon the ballast tamping tool implements are mounted, drive means for vibrating and reciprocating the tamping tool implements mounted on the carrier and connected to the implements, the drive means comprising an eccentric shaft and reciprocating motors connected respectively to the eccentric shaft and to the tamping tool implements, a housing on the carrier through which the eccentric shaft extends and defining an oil sump in the lower portion thereof, bearings rotatably mounting the eccentric shaft in the housing, the bearings being lubricated by the oil from the sump, and each of the tamping tool implements being constituted by a rigid unit consisting essentially of a tamping tool holder having an arm having a longitudinal plane of symmetry and mounted on the carrier for pivoting in a plane vertical to the track and passing through the rail, the longitudinal plane of symmetry of the tamping tool holder arm extending in the vertical plane and the holder arm being connected to an outer end of a respective one of the reciprocating motors, the outer ends of the reciprocating motors extending through bores in the housing and being guided therein, sealing means substantially preventing oil leaking from the housing through the bores, and two arms extending transversely of the track and rigidly connected to the vertically extending arm to the left and to the right of the vertical plane, and at least one tamping tool stationary with respect to, and mounted on, each of the transversely extending holder arms and extending vertically downwardly from the holder arms for immersion in the ballast to the left and to the right of the rail.

2. The mobile track tamper of claim 1, wherein the sealing means is constituted by elastic, substantially bellows-shaped sleeves having respective ends affixed to the reciprocating motors and to the housing in a manner substantally preventing oil leaking from the housing.

3. The mobile track tamper of claim 2, wherein the reciprocating motors have piston rods reciprocating in cylinders and operated by hydraulic fluid for reciprocating the tamping tool implements.

4. The mobile track tamper of claim 3, further comprising bearings linking the cylinders to the eccentric shaft, the bearings being lubricated by the oil from the sump.

5. The mobile track tamper of claim 4, further comprising a pump having an input in communication with the oil sump and an output in communication with the bearings for pumping oil from the sump to the bearings.

6. The mobile track tamper of claim 5, further comprising spray nozzles arranged in communication with the output of the pump and oriented towards the bearings for spraying the pumped oil thereon.

7. The mobile track tamper of claim 5, further comprising a transmission from the eccentric shaft to the pump for driving the pump by the eccentric shaft.

8. The mobile track tamper of claim 7, wherein the transmission is a V-belt drive arranged outside the housing and connecting the eccentric shaft to the pump shaft.

* * * * *